United States Patent [19]

Laufer

[11] 3,945,360

[45] Mar. 23, 1976

[54] RPM REGULATOR FOR FUEL INJECTION PUMPS

[75] Inventor: Helmut Laufer, Stuttgart, Germany

[73] Assignee: Robert Bosch GmbH, Stuttgart, Germany

[22] Filed: Sept. 24, 1974

[21] Appl. No.: 508,890

[30] Foreign Application Priority Data

Oct. 3, 1973 Germany..... 2349692

[52] U.S. Cl...... 123/139 AD; 123/139 AF; 123/139 BD; 123/140 FG; 417/282; 417/289

[51] Int. Cl.[2]..... F02M 59/24; F02D 1/04

[58] Field of Search..... 123/140 R, 140 A, 140 FG, 123/139 BD, 139 AP, 139 AD, 139 AR, 139 AB, 139 AF, 139 AA, 139 AC; 417/294, 282, 289

[56] References Cited

UNITED STATES PATENTS

| | | | |
|---|---|---|---|
| 2,914,056 | 11/1959 | Hughson et al. | 123/140 R |
| 3,635,603 | 1/1972 | Eheim | 417/282 |
| 3,640,258 | 2/1972 | Isobe et al. | 123/140 FG |

FOREIGN PATENTS OR APPLICATIONS

| | | | |
|---|---|---|---|
| 1,576,116 | 7/1969 | Germany | 123/140 R |

*Primary Examiner*—Charles J. Myhre
*Assistant Examiner*—Tony Argenbright
*Attorney, Agent, or Firm*—Edwin E. Greigg

[57] ABSTRACT

An improved rpm regulator for a fuel injection pump associated with an internal combustion engine. The regulator includes a control lever, a fuel quantity control sleeve connected to the control lever, a regulating spring assembly connected to the control lever, a device for generating an rpm signal and applying a corresponding force through the control lever to the fuel quantity control sleeve in opposition to a force exerted by the regulating spring assembly and an adjustment lever connected to the regulating spring assembly for adjusting the preload exerted by the regulating spring assembly. The regulating spring assembly is improved and includes two holding members containing two compression springs so that when the two holding members are moved outwardly relative to each other the two springs are compressed. The springs are chosen and the holding members designed so as to minimize the degree of variation which can occur during a control process.

4 Claims, 5 Drawing Figures

RPM REGULATOR FOR FUEL INJECTION PUMPS

BACKGROUND OF THE INVENTION

The present invention relates to an rpm regulator for fuel injection pumps associated with internal combustion engines of the type having a pivotable control lever which actuates a fuel quantity control sleeve of the injection pump. The control lever is urged to pivot by an rpm-dependent force which is opposed by the force exerted by a regulating spring assembly located in the suction chamber of the injection pump. The regulating spring assembly can be arbitrarily pre-compressed by an adjustment lever, and it includes at least one control spring lodged in a holding device consisting of two holding members.

When it is desired to obtain a low degree of variation during terminal downward regulation in fuel injection pumps which use centrifugal governors as rpm signal generators, the regulator springs must be weak (soft), and they may also be pre-compressed. Alternatively, a combination consisting of several springs of which one is a weak, pre-compressed spring, may be provided. The limit of the achievable degree of variation is set by the degree of softness of the spring which is used as a control spring in the injection pump while avoiding negative influences on the control process caused by the high frequency mechanical oscillations generated in the operation of the injection pump. Such influences would adversely affect the fuel regulation and hence also the quiet and smooth running of the internal combustion engine which is supplied by the injection pump.

A known regulator of the above-described type uses a tension spring which has one end hooked onto a first connecting member between a setting lever and a control lever and has the other end hooked onto a second connecting member between the setting lever and the control lever. The second connecting member is pressed by the tension spring against the head of a screw threaded into the first connecting member, with the pre-compression of the tension spring being determined by the depth of insertion of the screw.

This arrangement has the disadvantage that the hook-on points of the spring can be unintentionally displaced, which would result in a change of the pre-compression of the spring during the operation of the pump. In addition, this mechanism is not stable with respect to lateral forces and buckling. Furthermore, when the regulator regulates downwardly, i.e. toward shut-off, and the second connecting member lifts off from the head of the screw, and oscillation of the entire assembly may occur. In this installation the setting lever at first determines the injected fuel quantity by means of the pre-compressed spring. The soft spring becomes effective only in the case of downward regulation and only after the pre-compression of the control spring has been overcome by the centrifugal force governor, so that, as has already been described above, a certain degree of variation determined by the softness of the spring, may be achieved. However, this degree of variation cannot be as small as desired due to the propensity of this arrangement to malfunction.

Another rpm governor is known in which centrifugal forces displace a bushing on a shaft against the force of a control spring. This bushing is provided with a throttle aperture for the purpose of damping any oscillations; during changes of the volume enclosed between the shaft and the bushing, fuel is displaced through the throttle aperture. In this way, mechanical oscillations which might affect the regulator are damped throughout the entire effective domain of the rpm governor. However, this mechanism cannot achieve precise damping aimed at special operational points and at the conditions prevailing there. In particular, it might be undesirable if the damping effect in the middle operational domain were too high to permit a sufficiently fast-acting control process.

OBJECT AND SUMMARY OF THE INVENTION

It is an object of the present invention to provide a regulating spring assembly for use in an rpm governor of the above-mentioned kind for a fuel injection pump, by means of which an especially low degree of variation may be achieved.

This object, and others, are achieved according to the invention, in that the control spring assembly consists of at least two separate compression springs which are held in position by two holding members. The springs are separated by a piston that moves sealingly in a cylinder, the bottom end of which is closed and which serves as the first holding member. When a tensile force causes the relative motion of the two holding members with respect to one another, the springs are compressed. The volume enclosed between the bottom of the cylinder and the piston is filled with fuel and is in constant communication with the suction chamber of the pump through a throttle aperture.

In this way, advantageously, only one of the two control springs and the control domain associated with that spring is subject to additional damping by the throttle, so that this one spring may be made weaker than would be justifiable without the additional damping.

In an advantageous development of the invention, the cylinder is provided with an internal stop against which the piston may be pressed by a compression spring enclosed between the bottom of the cylinder and the piston, whereas the other compression spring is lodged between the piston and a U-shaped second holding member which partially extends into the cylinder and partially envelops it. This arrangement has the first advantage that the compression spring held between the bottom of the cylinder and the piston may be made very soft. Secondly, this spring becomes effective only after its pre-compression force has been overcome, for example in the downward controlling region, i.e. toward shut-off. In this way, a very low coefficient of fluctuations may be attained.

It is another advantageous feature of the invention that the second holding member is embodied as a stamped metal part and that the cylinder is equipped with longitudinal slits through which the second holding member partially extends into the cylinder.

It is yet another advantageous feature of the invention that the cylinder is provided near its bottom with two diametrically opposite, fork-shaped guide tabs which are engaged by the second holding member. In this manner, the cylinder is precisely guided and positioned in the surrounding holding member so that buckling or oscillation of the control spring assembly, which would adversely affect the control process, is not possible.

BRIEF DESCRIPTION OF THE DRAWING

Two exemplary embodiments of the invention are shown in the drawing and are described in detail below.

DESCRIPTION OF THE PREFERRED EMBODIMENTS

Figure 1:
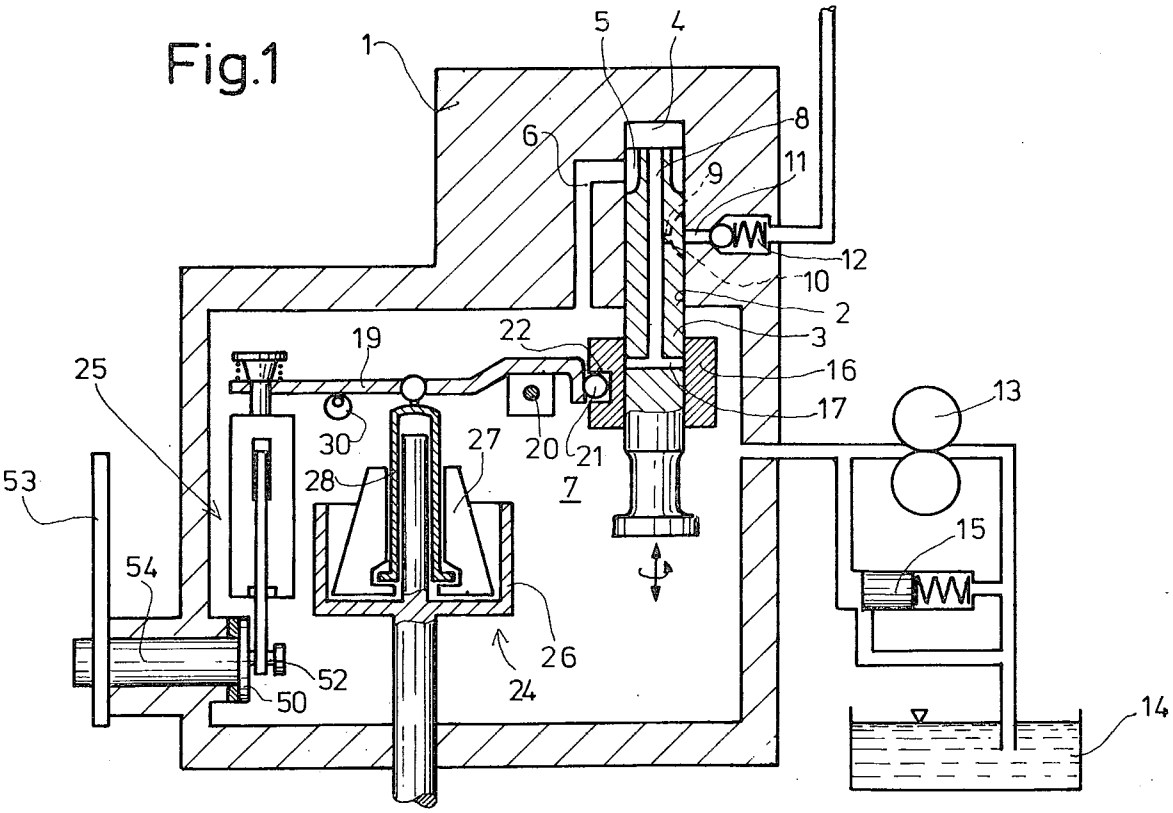
FIG. 1 is a cross-section through a fuel injection pump including the rpm regulator according to the invention.

Turning now to FIG. 1, a schematically represented housing 1 of a fuel injection pump is shown, within which certain of the operative elements are housed. The housing 1 includes a bore 2 within which a pump piston 3 is mounted. The piston 3 is set for simultaneous rotating and reciprocating motion by means (not shown). The bore 2 and piston 3 define a working chamber 4. The pump working chamber 4 is supplied with fuel through a respective one of a plurality of longitudinal grooves 5 formed in the outer surface of the pump piston 3 and through a bore 6 extending within the housing 1 and communicating with a suction chamber 7. Fuel is supplied to the chamber 4 while the pump piston 3 executes its suction stroke, or while it occupies its bottom dead-center position. As soon as the bore 6 is closed or hydraulically disconnected from the grooves 5 by rotation of the pump piston 3, fuel contained within the pump working chamber 4 is delivered as follows: through a longitudinal channel 8 extending within the pump piston 3; through a radial bore 9 and a longitudinal distributing groove 10, both formed in the wall of the pump piston 3; to one of several pressure conduits 11, which are distributed about the periphery of the bore 2 and whose number corresponds to the number of cylinders of the internal combustion engine (not shown); past a check valve 12 and thence to an injection valve (not shown) associated with each cylinder.

A fuel pump 13 delivers fuel from a fuel tank 14 to the suction chamber 7. A pressure control valve 15 so controls the pressure in the suction chamber 7 that, in a known manner, the pressure in the suction chamber 7 increases with increasing rpm.

Located on the pump piston 3 is an annular control sleeve 16 which controls the extent to which a radial bore 17 communicating with the axial bore 8 opens during the pressure stroke of the piston 3 in order to limit the total delivered fuel quantity. Once this aperture is opened, fuel can flow back into the suction chamber 7.

The control sleeve 16 is displaced by a control lever 19 which pivots about a shaft 20. For this purpose, the control lever 19 has a spherical head 21 thereon on one side of the shaft 20 which engages a recess 22 within the control sleeve 16. The other side of the control lever 19 is engaged by a member of a centrifugal force governor 24 acting as an rpm signal-generator which exerts its force against the control lever 19 in opposition to the force of a regulator spring assembly 25 also acting on the control lever 19. The centrifugal force governor 24 includes a carrier 26 for flyweights 27. The flyweights 27 and the carrier 26 are rotated by a gear train (not shown) in constant proportion to the rpm of the pump piston. The resultant centrifugal forces cause the excursion of the flyweights 27 and they displace a sleeve 28 located on the axis of the governor. The sleeve 28 exerts an rpm-dependent force on the control lever 19 at a single point. The farther the control sleeve 16 is moved downwardly by the pivotal motion of the control lever 19, the smaller is the fuel quantity delivered by the injection pump since the radial bore 17 is opened earlier during the delivery stroke of the pump piston 3 and a larger proportion of the fuel quantity which could have been delivered by the pump piston 3 flows back into the suction chamber 7. The maximum delivered fuel quantity is determined by the uppermost position of the control sleeve 16 and this position is limited by an eccentrically adjustable stop 30 for the control lever 19. The extent of the downward displacement of the control sleeve 16 at a certain rpm depends on the force exerted by the regulating spring assembly 25 on the control lever 19.

Figure 2:
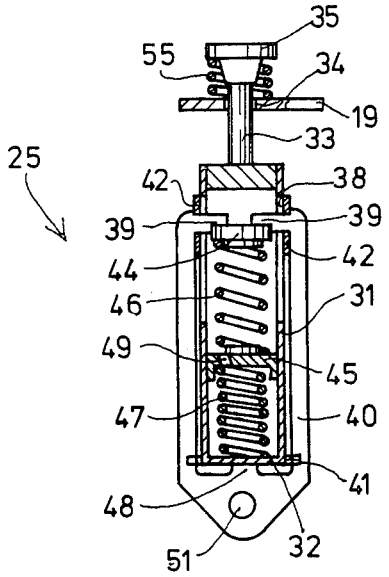
FIG. 2 is a more detailed view of a first exemplary embodiment of the control spring assembly according to the invention.

The construction of the regulating spring assembly 25 will now be described in further detail with reference to FIG. 2. The spring assembly consists essentially of two holding members. The first holding member is a cylinder 31 with a closed bottom 32. Fastened to its upper end is a rod 33 which extends through a hole 34 in the control lever 19 and has a head 35. Located in the upper half of the cylinder are two diametrically opposite, longitudinal slits 38 which are engaged by the hook-shaped ends 39 of a generally U-shaped second holding member 40. The holding member 40 is preferably a stamped metal part and is guided in the longitudinal slits 38 and also within two fork-shaped tabs 41 which extend radially outward from the bottom region of the cylinder and are diametrically opposed. For additional lateral guidance, each of the hook-shaped ends 39 of the second holding member 40 is equipped with a guide rail 42.

A spring support 44 is connected to the hook-shaped ends 39 within the interior of the cylinder 31. A compression spring 46 is supported between the spring support 44 and a piston 45, sealingly slidable with the cylinder 31. A second compression spring 47 is lodged between the bottom 32 and the piston 45. These two compression springs press the bottom of the cylinder 31 against a stop 48 formed on the U-shaped second holding member 40 enveloping the cylinder 31.

The bottom of the piston 45 is provided with a throttle aperture 49 through which fuel contained within the cylinder may flow to equalize the pressure when the piston is displaced. In the position shown in FIG. 2, the pre-compressed springs 46, 47 cause the two holding members of the control spring assembly to act as a rigid body disposed between the control lever 19 and a setting lever 50 (FIG. 1). A stud 52, to which the setting lever 50 is connected, passes through a hole 51 in the U-shaped second holding member 40. Thus the setting lever 50, which may be arbitrarily turned from outside the pump housing via a lever 53 and a shaft 54, can change the pre-compression of the springs 46 and 47 by causing the relative axial motion of the cylinder 31 with respect to the U-shaped holding member 40. An idling spring 55 is also disposed between the head 35 and the control lever 19.

The rpm-regulator operates in the following manner: when the fuel injection pump is stopped, the control lever is biased into the engagement with the stop 30 as shown in FIG. 1, so that the control sleeve 16 is in a position which corresponds to maximum fuel delivery. When the lever 53 is completely pulled back, the head 35 is in the position shown in FIG. 2, i.e. it is lifted off from the control lever 19 by the idling spring 55. After the start-up of the engine, the control lever 19 is pivoted about the axis 20 by the centrifugal force governor 24 in opposition to the force of the idling spring 55. The quantity of fuel supplied by the injection pump thus decreases from the full-load quantity to the idling quantity. At the outset, the control spring assembly 25 acts as a rigid body due to the pre-compression of the springs 46 and 47, so that the rotation of the lever 53 results in a desired quantity of injected fuel. However, when the rpm increases to a point at which the clockwise torque exerted on the control lever 19 by the centrifugal forces exceeds the counterclockwise torque resulting from the pre-compression of the control springs 46 and 47, then these springs are further compressed so that the control lever 19 may pivot clockwise about its axis, displacing the control sleeve 16 downwardly, thus reducing the injected fuel quantity.

Figure 4:
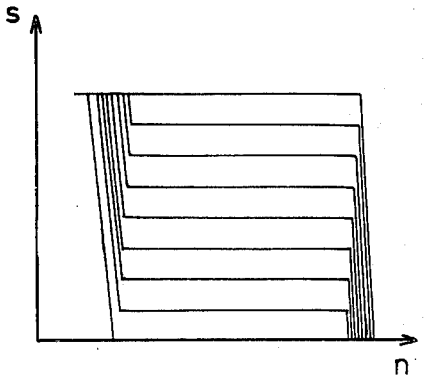
FIG. 4 shows a set of characteristic curves which are obtained when using the control spring assembly according to FIG. 2.

The regulator is now regulating downwardly, i.e. toward "stop." In this process it is advantageous if the two control springs 46 and 47, of which the control spring 47 is an especially soft spring, are precompressed approximately so as to correspond to the terminal minimum rpm. This mechanism produces the characteristic curves shown in the diagram of FIG. 4. This graph displays the control path S traversed by the control sleeve 16 as a function of the rpm $n$ for various conditions of load. If a steep decrease of the characteristic curve at the terminal rpm, such as is shown in FIG. 4, is to be achieved, i.e. if a very small degree of variation must be attained, then the control springs must be very soft springs. The intermediate piston 45, provided with the throttle bore 49, prevents oscillations of the control mechanism and, hence, of the rpm of the internal combustion engine, in the downward regulating domain of the rpm regulator. Thus, high-frequency fluctuations of the control forces of the rpm-regulator can affect only the more rigid spring 46. Similarly, the precise guidance of the cylinder 31 within the U-shaped holding member 40 prevents oscillation of the control spring assembly 25. Such an oscillation would change the injected fuel quantity in a periodic manner and would make the internal combustion engine run very rough.

Figure 3:
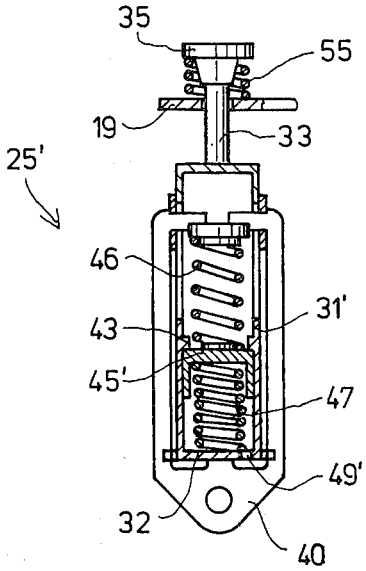
FIG. 3 is a more detailed view of a second exemplary embodiment of the control spring assembly according to the invention.
Figure 5:
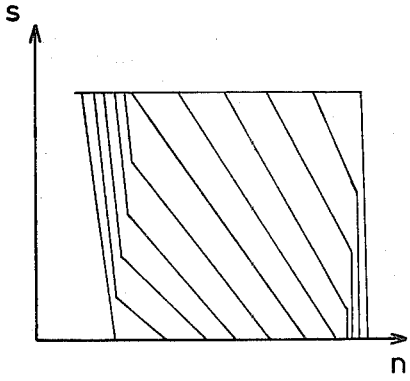
FIG. 5 shows a set of characteristic curves applicable when using the exemplary embodiment of the control spring assembly according to FIG. 3.

FIG. 3 depicts a second embodiment of the invention. The control spring assembly 25′ shown there is substantially identical to the control spring assembly 25 of FIG. 2, i.e. the basic functions of the assembly are the same as before. The novelty with respect to the previously described control spring assembly is that the cylinder 31′ of the control spring assembly 25′ has an internal, central stop 43 against which the piston 45 is pressed by the control spring 47 lodged between the piston and the cylinder bottom 32. In this embodiment, the throttle aperture 49′ is located in the bottom 32 of the cylinder. In this embodiment, because of the stop 43, the pre-compression of the lower, soft control spring 47 can be made greater than that of the upper control spring 46. Thus, during a relative motion of the cylinder 31′ with respect to the U-shaped holding member 40, the stiffer control spring 46 is compressed first until its force of compression is equal to the force of pre-compression of the weaker control spring 47. At this point, a steep downward regulating process begins and its behavior is primarily determined by the characteristic curve of the weak control spring 47, as is shown in the schematic diagram of FIG. 5. This diagram also shows the control path S traversed by the control sleeve 16 as a function of the rpm $n$. As in the previous embodiment during downward regulation, the throttle 49′ prevents high-frequency disturbing oscillations from affecting the regulating process and, hence, the rpm of the internal combustion engine. Such influences, which would be triggered primarily by the weak control spring 47, are damped by the throttle, i.e. as concerns high frequency oscillations, the control spring 47, disposed between the piston 45 and the cylinder bottom 32 within a closed-off fuel volume, acts as a rigid body. The low frequency control motions, however, can easily alter the degree of compression of the control spring.

Of course, it would be possible to change the cross section of the throttle aperture by means of a screw or the like and the aperture could be located in the cylinder bottom 32, in the piston 49 or in some non-closable location of the cylinder wall. Similarly, the pre-compression of the control springs could be changed by the insertion of spacer discs or by adjusting the stops by means of a screw.

What is claimed is:

1. In an rpm regulator for use with a fuel injection pump associated with an internal combustion engine, said regulator including a housing within which a suction chamber is defined, a control lever, a regulating spring assembly including at least one spring connected to the control lever, a device for generating an rpm signal and applying a corresponding force to the control lever in opposition to a force exerted by the regulating spring assembly, and an adjustment lever connected to the regulating spring assembly for adjusting the preload exerted by the regulating spring assembly, the improvement in the regulating spring assembly comprising:

a. two holding members;
b. two compression springs mounted within the holding members;
c. a cylinder having a closed bottom portion and serving as one of the holding members; and
d. a piston sealingly displaceable within said cylinder, said piston including a throttle aperture therein and defining an enclosed volume with said cylinder between said piston and the bottom portion of said cylinder, said enclosed volume being filled with fuel and being in communication with the suction chamber through said aperture, wherein said piston serves to separate the two compression springs from each other, and wherein relative outward movement of said holding members results in compression of said springs.

2. An rpm regulator as defined in claim 1, wherein the other holding member is U-shaped and partially envelopes said cylinder, said other holding member including a portion which extends into said cylinder and serves to contain one of the springs between said piston and said portion, wherein the other spring is contained within said enclosed volume, and wherein said cylinder is provided with an internally extending stop against which said piston is biased by said other spring.

3. An rpm regulator as defined in claim 2, wherein the other holding member comprises a stamped metal part, and wherein said cylinder includes a pair of longitudinal slits formed in its wall through which said portion extends.

4. An rpm regulator as defined in claim 3, wherein said cylinder includes a pair of fork-shaped guide tabs near the closed bottom portion thereof which are engaged by said other holding member.

* * * * *